US007438541B2

(12) United States Patent
Aya et al.

(10) Patent No.: US 7,438,541 B2
(45) Date of Patent: Oct. 21, 2008

(54) HERMETIC ROTARY COMPRESSOR

(75) Inventors: Toru Aya, Shiga (JP); Toshiharu Yasu, Shiga (JP); Hiroshi Matsunaga, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 12/034,212

(22) Filed: Feb. 20, 2008

(65) Prior Publication Data

US 2008/0145256 A1 Jun. 19, 2008

Related U.S. Application Data

(62) Division of application No. 11/387,344, filed on Mar. 23, 2006, now abandoned.

(30) Foreign Application Priority Data

Mar. 24, 2005 (JP) ..... 2005-085492
Nov. 30, 2005 (JP) ..... 2005-345669

(51) Int. Cl.
*F03C 2/00* (2006.01)
*F01C 21/04* (2006.01)
*F04C 29/02* (2006.01)

(52) U.S. Cl. ..... 418/60; 418/91; 418/92; 418/94; 418/63; 184/6.18

(58) Field of Classification Search ..... 418/91, 418/92, 94, 15, 16, 22, 23, 24, 60, 209, 210, 418/223, 224, 248, 249
See application file for complete search history.

(56) References Cited

U.S. PATENT DOCUMENTS 5,074,761 A 12/1991 Hirooka et al.
5,098,266 A 3/1992 Takimoto et al.
5,242,280 A 9/1993 Fujio
5,314,318 A 5/1994 Hata et al.
5,443,376 A 8/1995 Choi
5,518,381 A * 5/1996 Matsunaga et al. ..... 418/60
5,685,703 A 11/1997 Fukuoka et al.
6,250,899 B1 6/2001 Lee et al.
6,435,850 B2 8/2002 Sunaga et al.
7,128,540 B2 * 10/2006 Tadano et al. ..... 418/60
7,303,379 B2 * 12/2007 Ebara et al. ..... 418/92
2006/0002809 A1 1/2006 Kawabe et al.
2006/0225456 A1 10/2006 Aya et al.
2007/0154329 A1 7/2007 Onoda
2008/0003123 A1 * 1/2008 Byun et al. ..... 418/23

(Continued)

FOREIGN PATENT DOCUMENTS

JP 61-286596 12/1986

(Continued)

*Primary Examiner*—Thomas E Denion
*Assistant Examiner*—Mary A Davis
(74) *Attorney, Agent, or Firm*—RatnerPrestia

(57) ABSTRACT

A hermetic rotary compressor operates two cylinders simultaneously in the regular operation; however it halts operating one of the cylinders when it selects an operation with a half capacity. A vane room of the halted cylinder is air-tightly sealed with respect to lubricant atmosphere in a hermetic case. An oil-supplying groove is provided to a vane groove of the halted cylinder, and lubricant is supplied to the oil-supplying groove in order to lubricate the vane.

2 Claims, 10 Drawing Sheets

U.S. PATENT DOCUMENTS

2008/0112831 A1* 5/2008 Ogasawara ..... 418/60

FOREIGN PATENT DOCUMENTS

JP 01-247786 10/1989
JP 02-091494 3/1990
JP 2002-005062 A 1/2002
JP 2005-009455 A 1/2005

* cited by examiner

HERMETIC ROTARY COMPRESSOR

This application is a Divisional of U.S. patent application Ser. No. 11/387,344 filed Mar. 23, 2006 the entire disclosure of which is incorporated herein by reference.

FIELD OF THE INVENTION

The present invention relates to hermetic rotary compressors to be used in air-conditioners or refrigerators, more particularly, relates to compressors which can change air-conditioning capacity or refrigerating capacity.

BACKGROUND OF THE INVENTION

The hermetic rotary compressor, in general, discharges compressed refrigerant gas into a hermetic case, so that the inside of the hermetic case becomes high pressure atmosphere. A piston formed of off-center rollers is accommodated in a cylinder room of the compressor. A front end of the vane is urged by a spring against the surface of the piston. The cylinder room is partitioned by the vane into a sucking space and a discharging space. The sucking space is connected to a sucking tube, and the discharging space opens into the hermetic case.

Unexamined Japanese Patent Publication No. H01-247786 discloses a hermetic rotary compressor having two cylinders. This compressor can change its air-conditioning capacity or refrigerating capacity by using both of the cylinders simultaneously or using one of the cylinders while halting the other one's compressing operation. The compressing operation can be halted by isolating the vane from the piston.

Although the compressor of this type is functionally advantageous over other types, a hermetic vane room is needed and thus placed behind the vane because the vane in a second cylinder room needs to be isolated forcibly from the piston. A vane room, in general, communicates with the inside of the compressor, so that it is always in the atmosphere of lubricant, and actually a sufficient amount of lubricant is supplied to its sliding section. However, the vane room of the compressor disclosed in the foregoing patent does not communicate with the inside of the compressor, so that the vane room forms a hermetic room. The sliding section of this vane thus has a possible problem that it cannot receive a sufficient amount of lubricant, and this problem invites wearing or seizing at the sliding section.

SUMMARY OF THE INVENTION

A hermetic rotary compressor of the present invention has a first and a second cylinders. The compressor operates those two cylinders simultaneously in regular operation. When a user selects a half capacity operation, the second cylinder halts its compressing operation by isolating the vane from the piston. The vane room of the second cylinder is air-tightly sealed with respect to the atmosphere of the hermetic case so that the vane can be isolated from the piston. The present invention provides a vane groove of the second cylinder with an oil-supplying groove in order to supply lubricant to the vane. This structure allows supplying a sufficient amount of lubricant to the vane although the vane room is air-tightly sealed.

DETAILED DESCRIPTION OF PREFERRED EMBODIMENTS

Exemplary embodiments of the present invention are demonstrated hereinafter with reference to the accompanying drawings.

Embodiment 1

Figure 1:
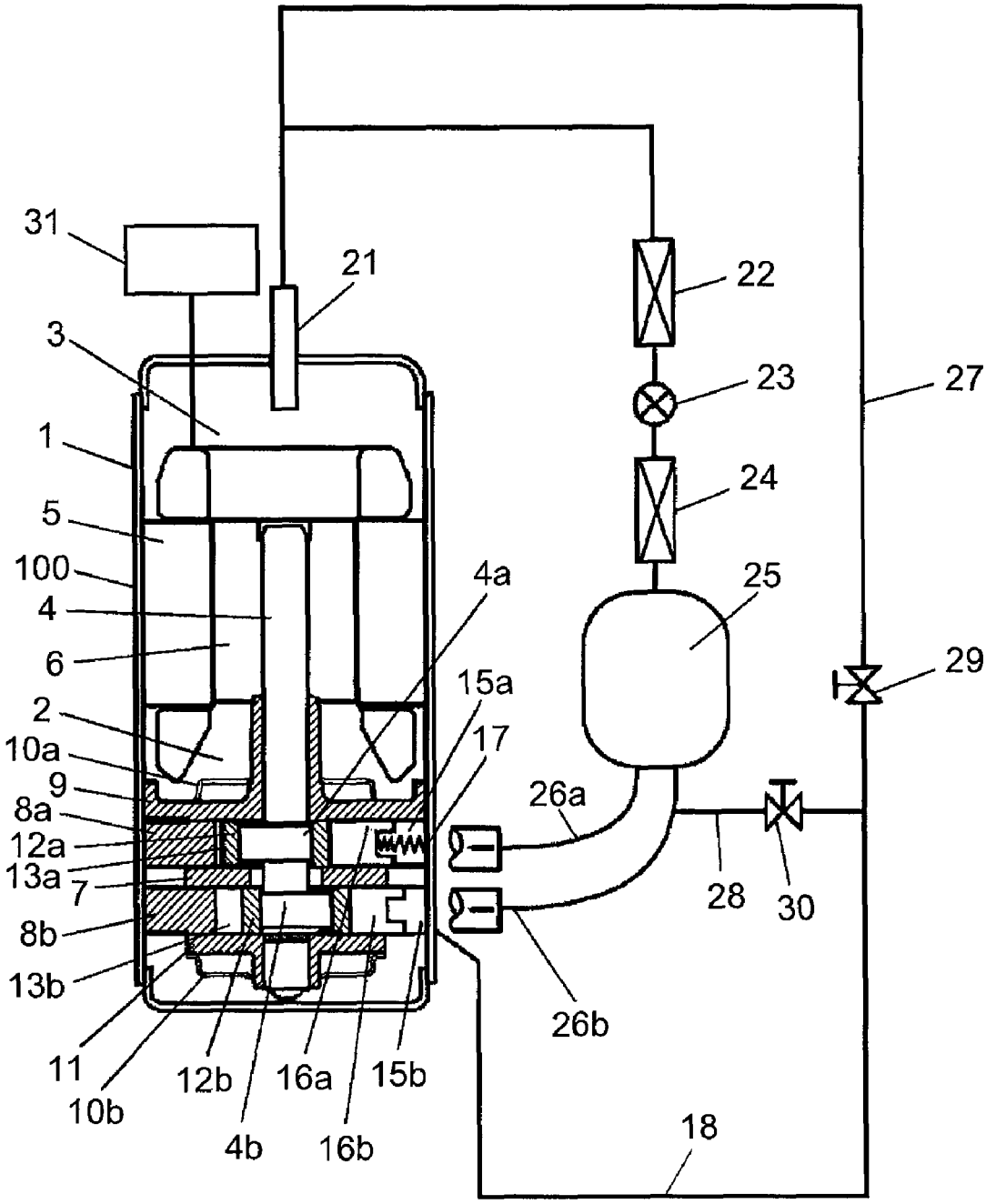
FIG. 1 shows a structure where a refrigerating cycle is formed in accordance with a first embodiment of the present invention.

FIG. 1 shows a structure where a refrigerating cycle is formed in accordance with the first embodiment of the present invention. Hermetic rotary compressor 100 comprises compressing section 2 linked to electric motor 3 with rotary shaft 4 in hermetic case 1. Motor 3 includes stator 5 and rotor 6. Compressing section 2 includes first cylinder 8*a* on partition plate 7 and second cylinder 8*b* beneath partition plate 7. Bearing frame 9 and valve cover 10*a* are rigidly mounted on a top face of first cylinder 8*a*. Bearing frame 11 and valve cover 10*b* are rigidly mounted beneath an underside of second cylinder 8*b*. Rotary shaft 4 includes off-center sections 4*a* and 4*b* having a phase difference of 180 degrees in between Off-center sections 4*a* and 4*b* have the same diameter, and fit into off-center rollers 12*a* and 12*b* at respective outer peripheries, thereby forming a piston.

Figure 2:
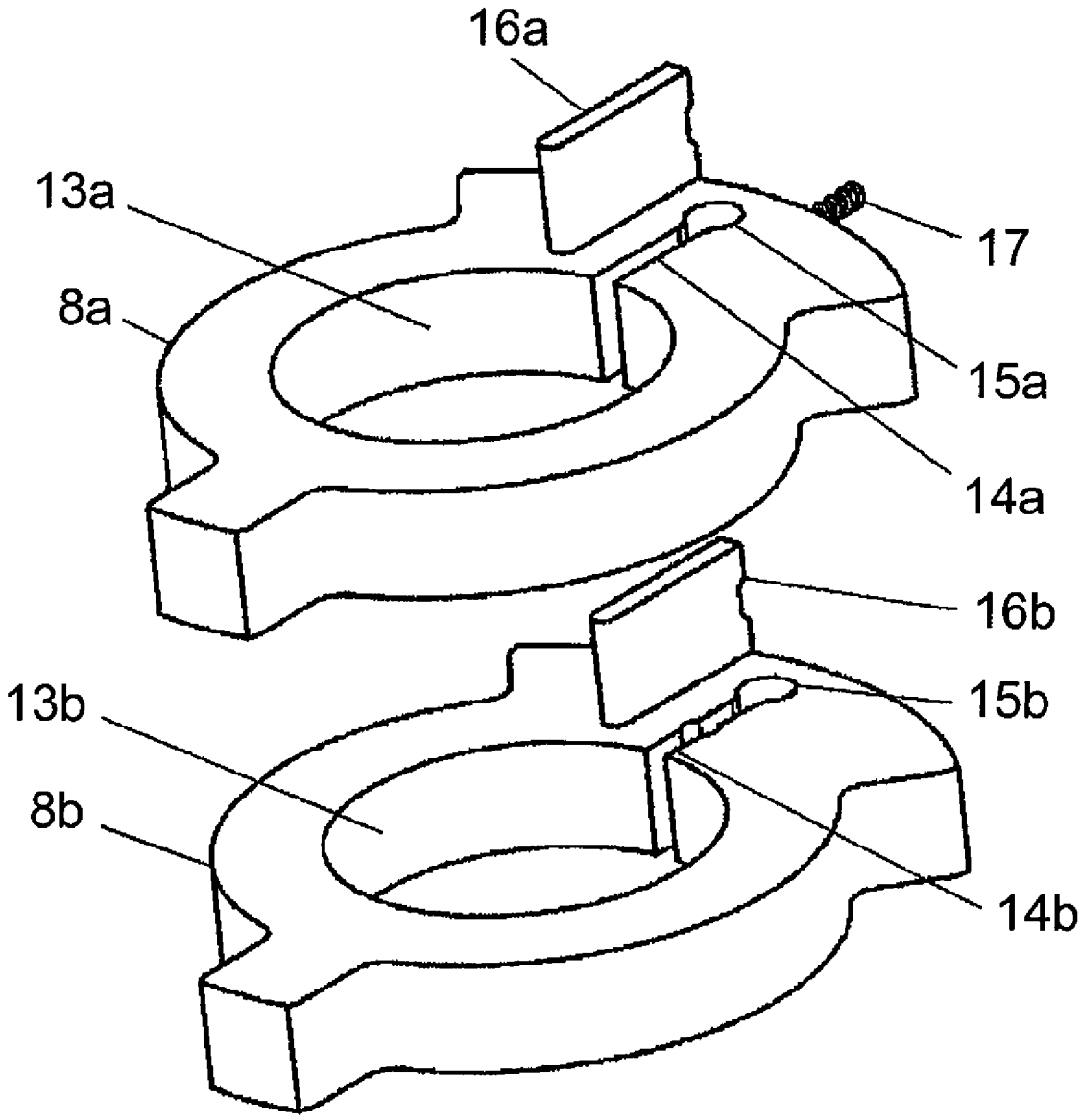
FIG. 2 shows an exploded view of a first cylinder and a second cylinder in accordance with the first embodiment.

As shown in FIG. 2, respective cylinders 8*a*, 8*b* include cylinder rooms 13*a*, 13*b*, vane grooves 14*a*, 14*b*, and vane rooms 15*a*, 15*b*. Vane 16*a*, 16*b* are accommodated in vane grooves 14*a*, 14*b* in a slidable manner. Vane room 15*a* accommodates spring member 17, which pushes the rear end of vane 16*a* so that the front end of vane 16*a* is urged against off-center roller 12*a*. Each one of the front ends of respective vanes 16*a*, 16*b* is shaped like a semi-circle, and keeps line-contact with the surface of respective off-center rollers 12*a*, 12*b*.

Since vane room 15*a* opens into the atmosphere of hermetic case 1, the rear end of vane 16*a* receives a high pressure from hermetic case 1. Vane room 15*b*, on the other hand, is air-tightly sealed with respect to the atmosphere of hermetic case 1, so that it forms an independent hermetic space.

Figure 3:
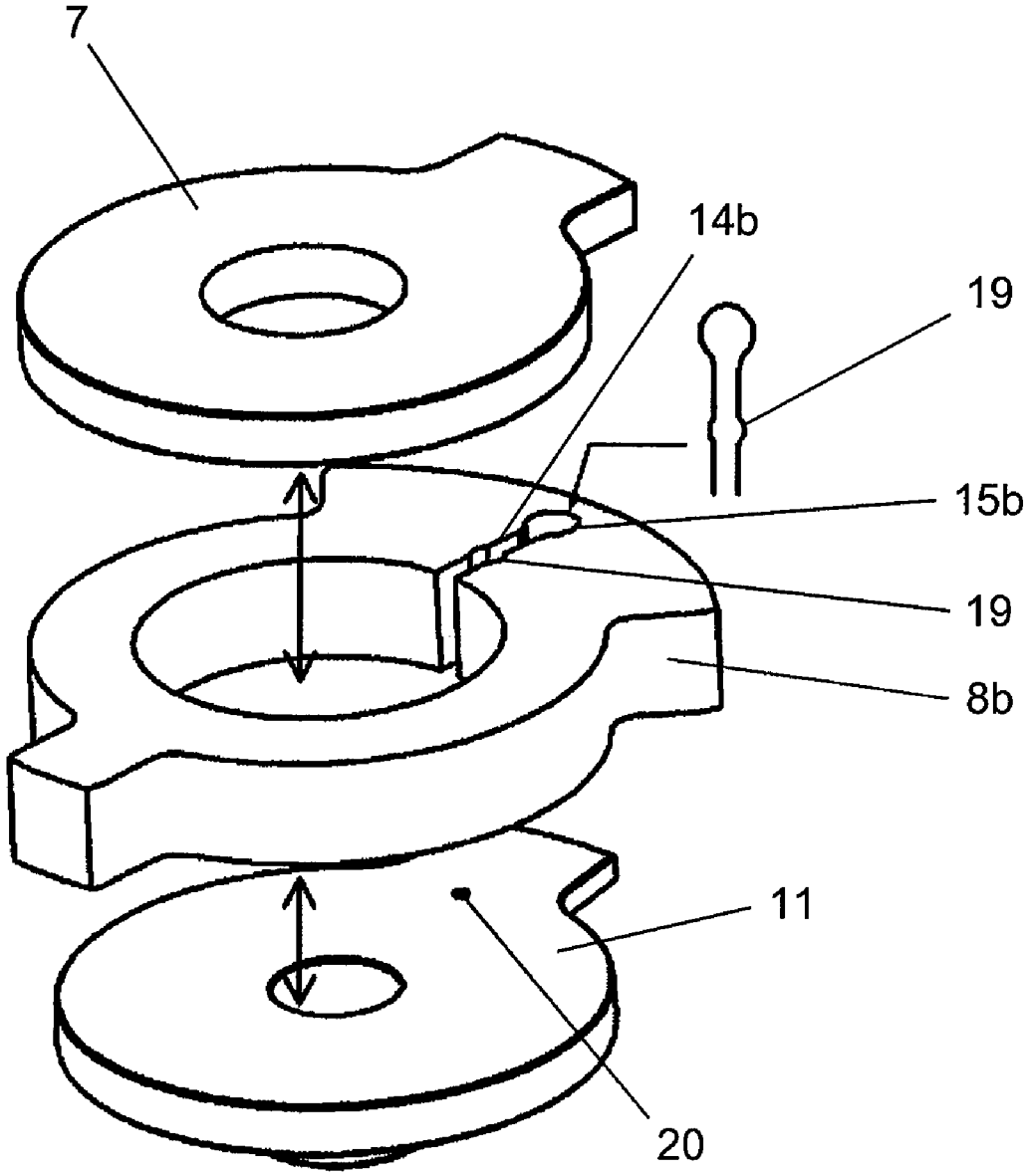
FIG. 3 shows an exploded view of a cylinder, a partition plate, and a bearing frame in accordance with a second embodiment of the present invention.

As shown in FIG. 3, partition plate 7 is rigidly mounted on the top face of second cylinder 8*b*, and bearing frame 11 is rigidly mounted beneath the underside of cylinder 8*b*, so that vane groove 14*b* and vane room 15*b* are air-tightly sealed at their top faces and undersides.

Since vane room 15*a* of first cylinder 8*a* opens into lubricant atmosphere in hermetic case 1, vane 16*a* receives a sufficient amount of lubricant. However, since vane room 15*b* of second cylinder 8*b* is air-tightly sealed, vane 16*b* receives only an insufficient amount of lubricant, and it sometimes suffers from a short supply of lubricant. In order to overcome this problem, oil-supplying groove 19 is provided to vane groove 14*b* as well as oil-passing hole 20 (refer to FIG. 4), which opens to the lubricant atmosphere of hermetic case 1, is provided to frame 11 of the second bearing. The lubricant is supplied to oil-supplying groove 19 via oil-passing hole 20 for lubricating vane 16*b*.

Figure 4:
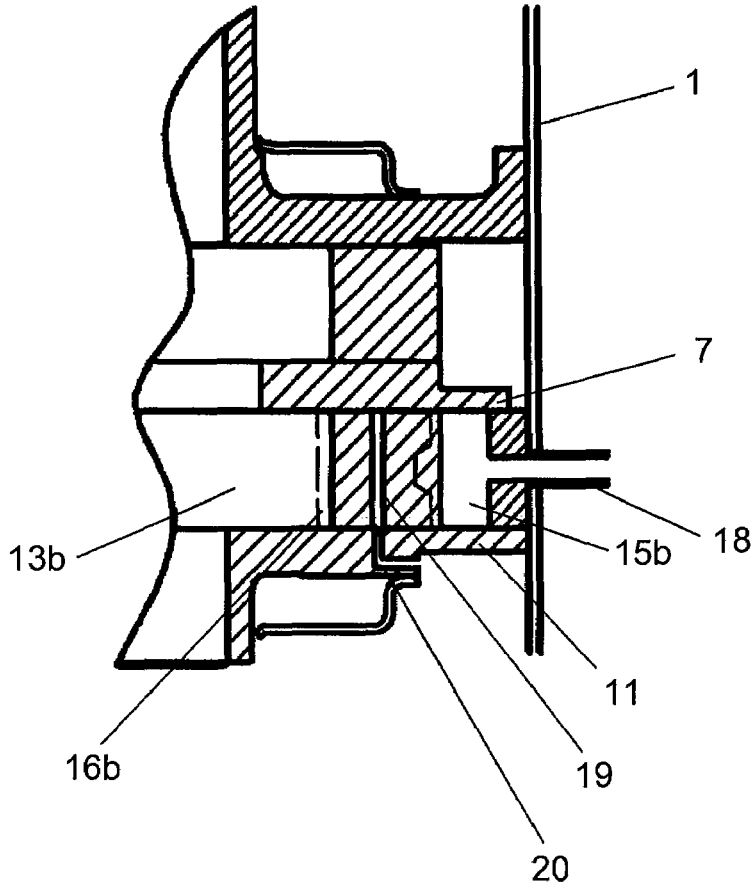
FIG. 4 shows a sectional view of the cylinder, partition plate, and bearing frame in accordance with the second embodiment.

As shown in FIG. 4, a space in vane room 15*b* communicates via pressure-introducing tube 18 with a pressure switching device (refer to FIG. 1) outside hermetic case 1. Vane 16*b* written in broken lines receives a pressure from cylinder room 13*b* at its front end, and receives a pressure introduced through pressure introducing tube 18 at its rear end. As a result, vane 16*b* is pushed to the lower pressure side because of the pressure difference between the front and rear ends.

Figure 5:
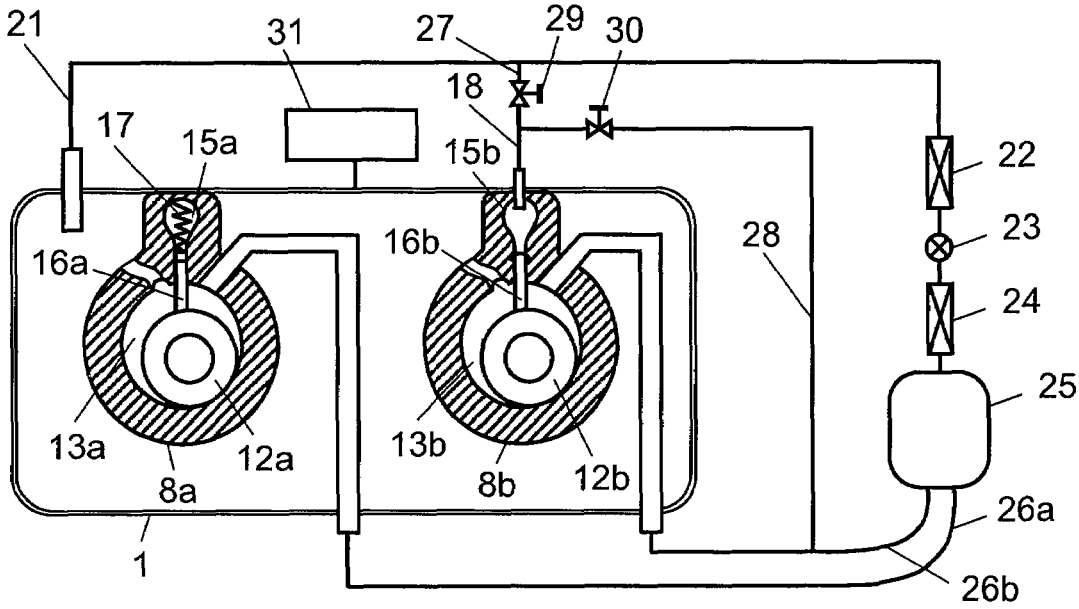
FIG. 5 shows a structure where a refrigerating cycle is formed in accordance with the second embodiment.

FIG. 5 shows a schematic diagram illustrating a structure of a refrigerating cycle in accordance with this first embodiment. Hermetic case 1 is coupled to discharging tube 21 at its top end. Discharging tube 21 is coupled to accumulator 25 via condenser 22, expansion mechanism 23, and evaporator 24. Accumulator 25 is coupled to sucking tubes 26*a*, 26*b*, which suck air into the compressor, at its underside. Sucking tubes 26*a*, 26*b* are led to cylinder rooms 13*a*, 13*b* via hermetic case 1.

Discharge pressure tube 27 having on-off valve 29 is placed between discharging tube 21 and pressure introducing tube 18. Suction pressure tube 28 having on-off valve 30 is placed between sucking tube 26*b* and pressure introducing tube 18. Pressure introducing tube 18 is led to vane room 15*b* of second cylinder 8*b*. The foregoing discharge pressure tube 27, suction pressure tube 28, on-off valves 29, 30 form a structure that leads a suction pressure (low pressure) or a discharge pressure (high pressure) to vane room 15*b*. On-off valves 29, 30 are electromagnetic valves that open or close in response to an electric signal supplied from controller 31. On-off valves 29 and 30 form the pressure switching device.

An operation of the refrigerating cycle shown in FIG. 5 is demonstrated hereinafter.

(1) Regular Operation (Full-Throttle Operation)

Controller 31 opens on-off valve 29 and closes on-off valve 30. In first cylinder 8*a*, the front end of vane 16*a* is urged against off-center roller 12*a* by spring 17, so that cylinder room 13*a* is partitioned into a sucking room and a compressing room.

Rotations of off-center roller 12*a* compresses refrigerant gas in cylinder room 13*a*, and the compressed gas is discharged into hermetic case 1. First cylinder 8*a* thus conducts compressing operation. The highly pressurized gas filled in hermetic case 1 is discharged outside hermetic case 1 via discharging tube 21.

Since on-off valve 29 is kept open, highly pressurized refrigerant gas supplied from discharge pressure tube 27 is led to vane room 15*b* of second cylinder 8*b*. Cylinder room 13*b* receives a suction pressure (low pressure) from accumulator 25. Vane 16*b* thus receives a low pressure at its front end and a high pressure at its rear end, so that the front end is urged against off-center roller 12*b*, and cylinder room 13*b* conducts compressing operation. The compressor thus operates on full-throttle using both of first and second cylinders 8*a*, 8*b*.

(2) Special Operation (Operation with Half-Capacity)

Controller 31 closes on-off valve 29 and opens on-off valve 30. First cylinder 8*a* conducts the same compressing operation as discussed above. The highly pressurized gas filled in hermetic case 1 is discharged outside hermetic case 1 via discharging tube 21.

Vane room 15*b* of second cylinder 8*b* receives a suction pressure (low pressure) from accumulator 25 via suction pressure tube 28, and at the same time, cylinder room 13*b* receives the suction pressure (low pressure) from accumulator 25.

Vane 16 receives a low pressure at both the front end and the rear end, so that no moving force is applied to vane 16. However, since off-center roller 12*b* rotates in cylinder room 13*b*, vane 16*b* is forcibly pushed into vane room 15*b*, so that vane 16*b* is isolated from roller 12*b* and stays there. Second cylinder 8*b* thus does not do compressing operation. As a result, the compressor operates with a half capacity using first cylinder 8*a* only.

The hermetic rotary compressor of the present invention allows supplying a sufficient amount of lubricant to oil-supplying groove 19 provided to vane groove 14*b*, so that vane 16*b* will not wear out caused by short supply of the lubricant. Oil-supplying groove 19 is disposed to vane groove 14*b*, which accommodates vane 16*b*, so that oil-supplying groove 19 does not damage the air-tightness of vane room 15*b*.

Embodiment 2

Figure 6:
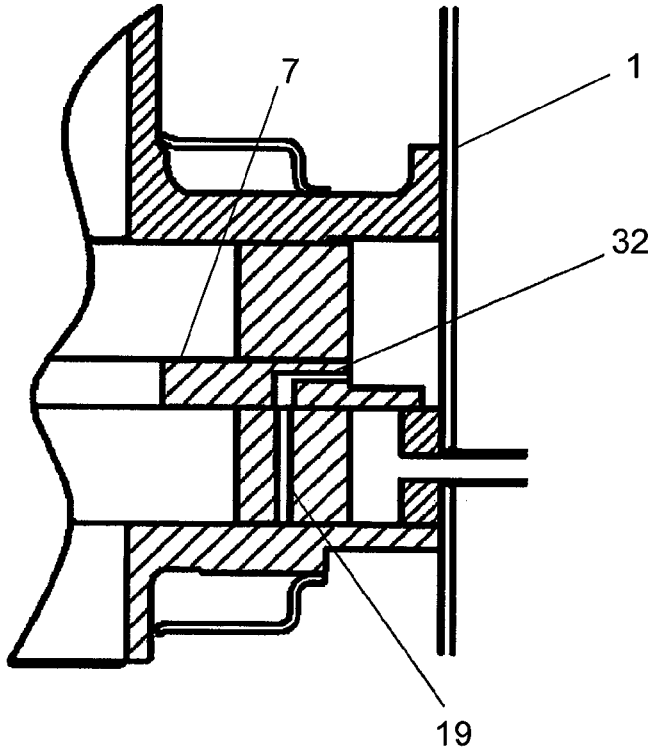
FIG. 6 shows a partial sectional view of a compressor in accordance with the second embodiment.

FIG. 6 shows the second embodiment of the present invention. Partition plate 7 has oil-passing hole 32 open into lubricant atmosphere in hermetic case 1. The lubricant is supplied to oil-supplying groove 19 via oil-passing hole 32 of partition plate 7.

Embodiment 3

Figure 7:
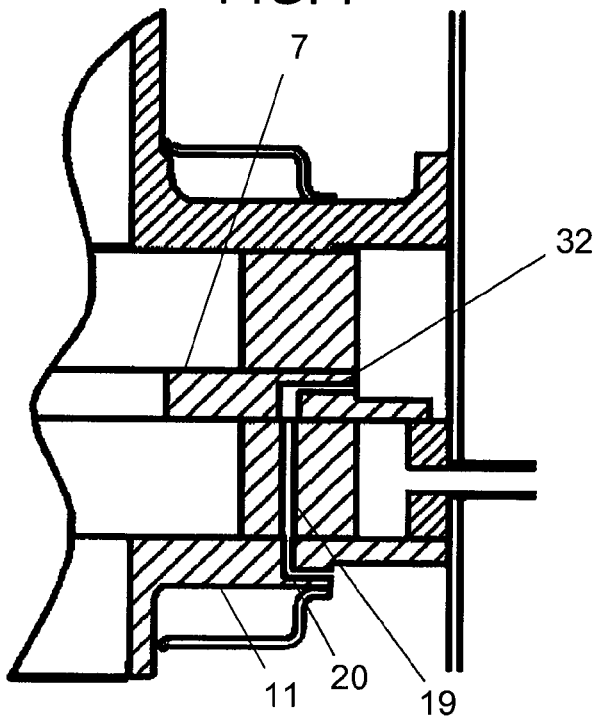
FIG. 7 shows a partial sectional view of a compressor in accordance with a third embodiment of the present invention.

FIG. 7 shows the third embodiment of the present invention. Partition plate 7 and bearing frame 11 have oil-passing holes 32 and 20 respectively, and the holes open into lubricant atmosphere in hermetic case 1. The lubricant is supplied to oil-supplying groove 19 via oil-passing hole 32 of partition plate 7 and oil-passing hole 20 of bearing frame 11.

Embodiment 4

Figure 8:
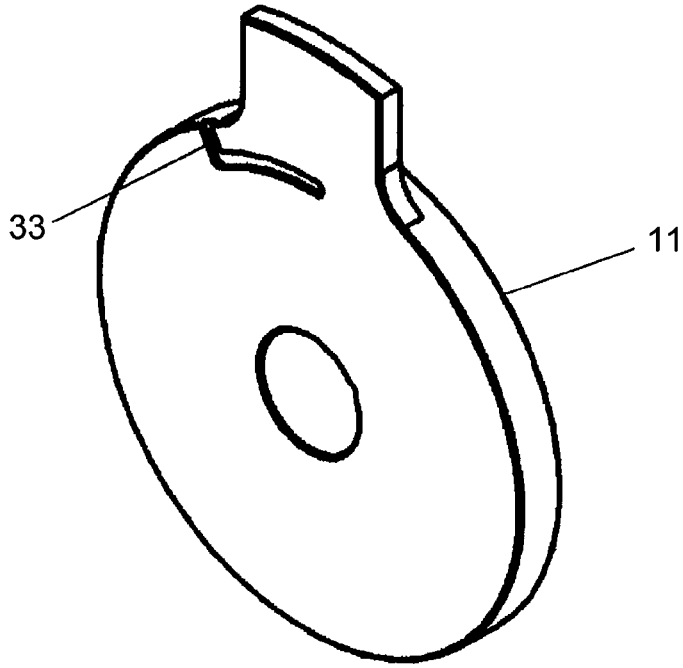
FIG. 8 shows a perspective view of a bearing frame in accordance with a fourth embodiment of the present invention.

FIG. 8 shows bearing frame 11 in accordance with the fourth embodiment of the present invention. Bearing frame 11 has oil-passing groove 33 open into lubricant atmosphere in hermetic case 1. The lubricant is supplied to oil-supplying groove 19 (not shown) via oil-passing groove 33 of bearing frame 11.

Embodiment 5

Figure 9:
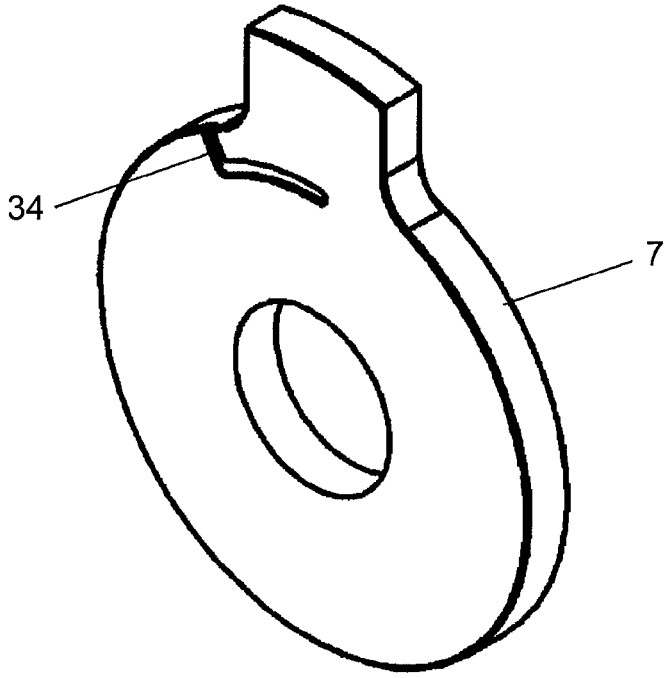
FIG. 9 shows a perspective view of a partition plate in accordance with a fifth embodiment of the present invention.

FIG. 9 shows partition plate 7 in accordance with the fifth embodiment of the present invention. Partition plate 7 has oil-passing groove 34 open into lubricant atmosphere in hermetic case 1. The lubricant is supplied to oil-supplying groove 19 (not shown) via oil-passing groove 34 of partition plate 7.

Embodiment 6

FIGS. 8, 9 show bearing frame 11 and partition plate 7 in accordance with the sixth embodiment of the present invention. Bearing frame 11 and partition plate 7 have oil-passing grooves 33, 34 respectively, and both of grooves 33, 34 open into lubricant atmosphere in hermetic case 1. The lubricant is supplied to oil-supplying groove 19 (not shown) via oil-passing grooves 33, 34 of bearing frame 11 and partition plate 7.

Embodiment 7

Figure 10:
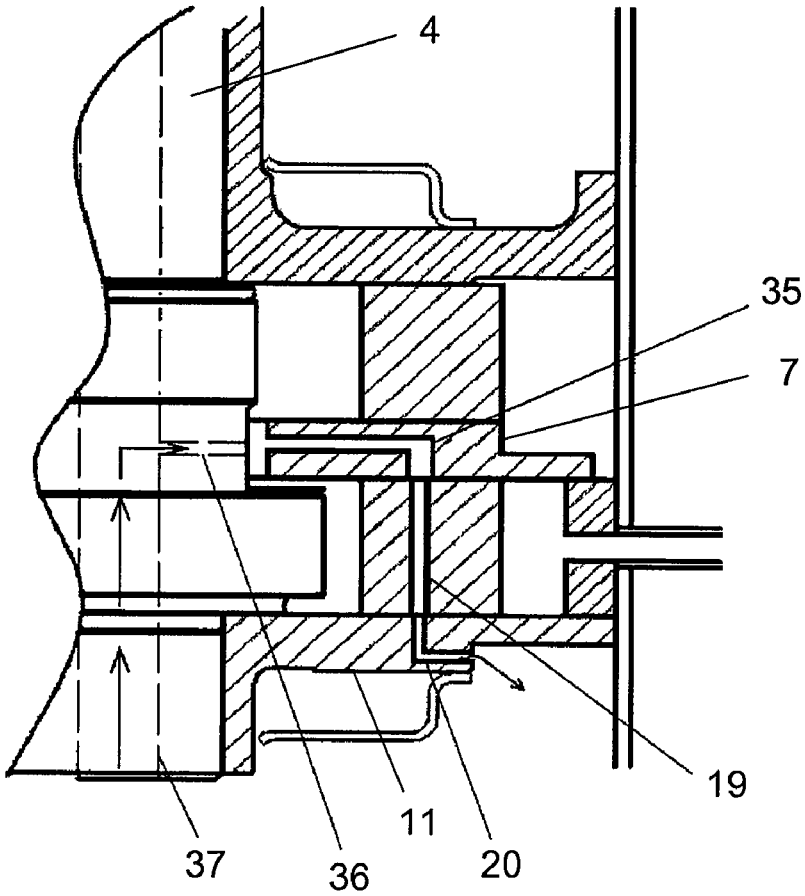
FIG. 10 shows a partial sectional view of a compressor in accordance with a seventh embodiment of the present invention.

FIG. 10 shows the seventh embodiment of the present invention. Oil-passing hole 36 open to the radial direction is disposed on rotary shaft 4 at between two off-center sections, namely, first and second off-center rollers 12*a*, 12*b*. Through-hole 37 is drilled in rotary shaft 4. Lubricant sucked from the underside of rotary shaft 4 into through-hole 37 is ejected from oil-passing hole 36 by centrifugal force.

Oil-passing hole 35 is provided to partition plate 7, hole 35 opens to rotary shaft 4. The lubricant ejected from hole 36 is supplied to oil-supplying groove 19 via oil-passing hole 35 of partition plate 7. Oil-passing hole 20 open to the atmosphere in hermetic case 1 is provided to bearing frame 11. In other words, rotary shaft 4 includes oil-passing hole 36 of which first end opens to the underside of shaft 4 and the second end opens to partition plate 7 at between first and second off-center rollers 12*a* and 12*b*.

Bearing frame 11 includes oil-passing hole 20 of which first end opens to oil-supplying groove 19 and the second end opens to the space in hermetic case 1. Partition plate 7 includes oil-passing hole 35 of which first end opens to oil-supplying groove 19 and the second and the second end opens to rotary shaft 4. This seventh embodiment allows the lubricant to circulate by centrifugal force, so that the compressor can be lubricated in a highly reliable manner.

Embodiment 8

Figure 11:
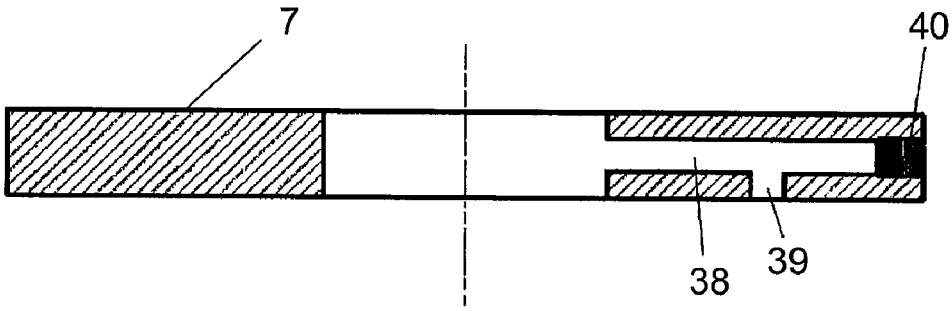
FIG. 11 shows a sectional view of a partition plate in accordance with an eighth embodiment of the present invention.

FIG. 11 shows the eighth embodiment of the present invention. Oil-passing hole 35 (shown in FIG. 10) of partition plate 7 is formed of through-hole 38 drilled in the radial direction, vertical hole 39, and packing 40, so that the oil-passing hole can be formed with ease.

Embodiment 9

Figure 12:
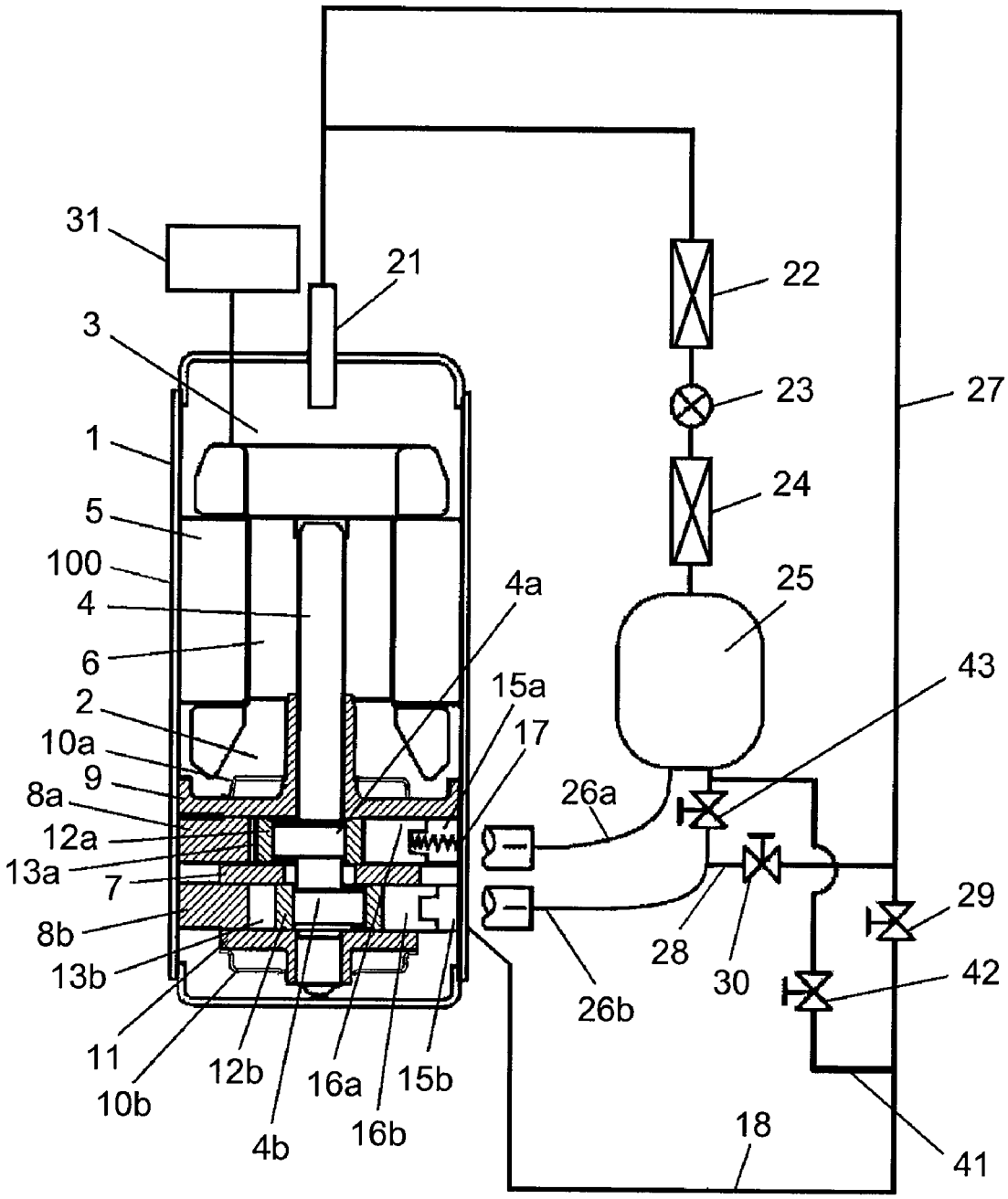
FIG. 12 shows a structure where a refrigerating cycle is formed in accordance with a ninth embodiment of the present invention.

The refrigerating cycle shown in FIG. 12 illustrates the ninth embodiment of the present invention. First on-off valve 29 is coupled between a discharge pressure (high pressure) and vane room 15*b*. Second on-off valve 30 is coupled between the discharge pressure (high pressure) and cylinder room 13*b*. Third on-off valve 42 is coupled between a suction pressure (low pressure) and vane room 15*b*. Fourth on-off valve 43 is coupled to the suction pressure and cylinder room 13*b*.

The foregoing on-off valves 29, 30, 42, and 43 are electromagnetic valves that open or close in response to electrical signals from controller 31, and those valves form the pressure switching device.

The operation of the refrigerating cycle shown in FIG. 12 is demonstrated hereinafter.

(1) Regular Operation (Full-Throttle Operation)

Controller 31 opens on-off valves 29, 43 and closes valves 30, 42. First cylinder 8*a* carries out the same compressing operation as it does in the first embodiment. Highly pressurized gas filled in hermetic case 1 is discharged outside hermetic case 1 via discharging tube 21. Since valve 29 is open, a discharge pressure (high pressure) supplied from discharge pressure tube 27 is led to vane room 15*b* of second cylinder 8*b*. Since fourth valve 43 is open, cylinder room 13*b* receives a suction pressure (low pressure) from accumulator 25.

Vane 16*b* receives the low pressure at its front end and receives the high pressure at its rear end, so that the front end is urged against off-center roller 12*b* and cylinder room 13*b* carries out compressing operation. As a result, the compressor operates on full-throttle using both of first and second cylinders 8*a* and 8*b*.

(2) Special Operation (Operation with Half-Capacity)

Controller 31 closes on-off valves 29, 43 and opens valves 30, 42. First cylinder 8*a* carries out the same compressing operation as it does in the first embodiment. Highly pressurized gas filled in hermetic case 1 is discharged outside case 1 via discharging tube 21. Since valve 42 is open, vane room 15*b* of second cylinder 8*b* receives the suction pressure (low pressure) through pressure-introducing tube 18. Since valve 30 is open, cylinder room 13*b* receives a discharge pressure (high pressure). Vane 16*b* receives the high pressure at its front end and receives the low pressure at its rear end, so that vane 16*b* is forcibly accommodated in vane room 15*b*. Second cylinder 8*b* thus does not carry out the compressing operation. As a result, the compressor operates with a half capacity using first cylinder 8*a* only.

Figure 13:
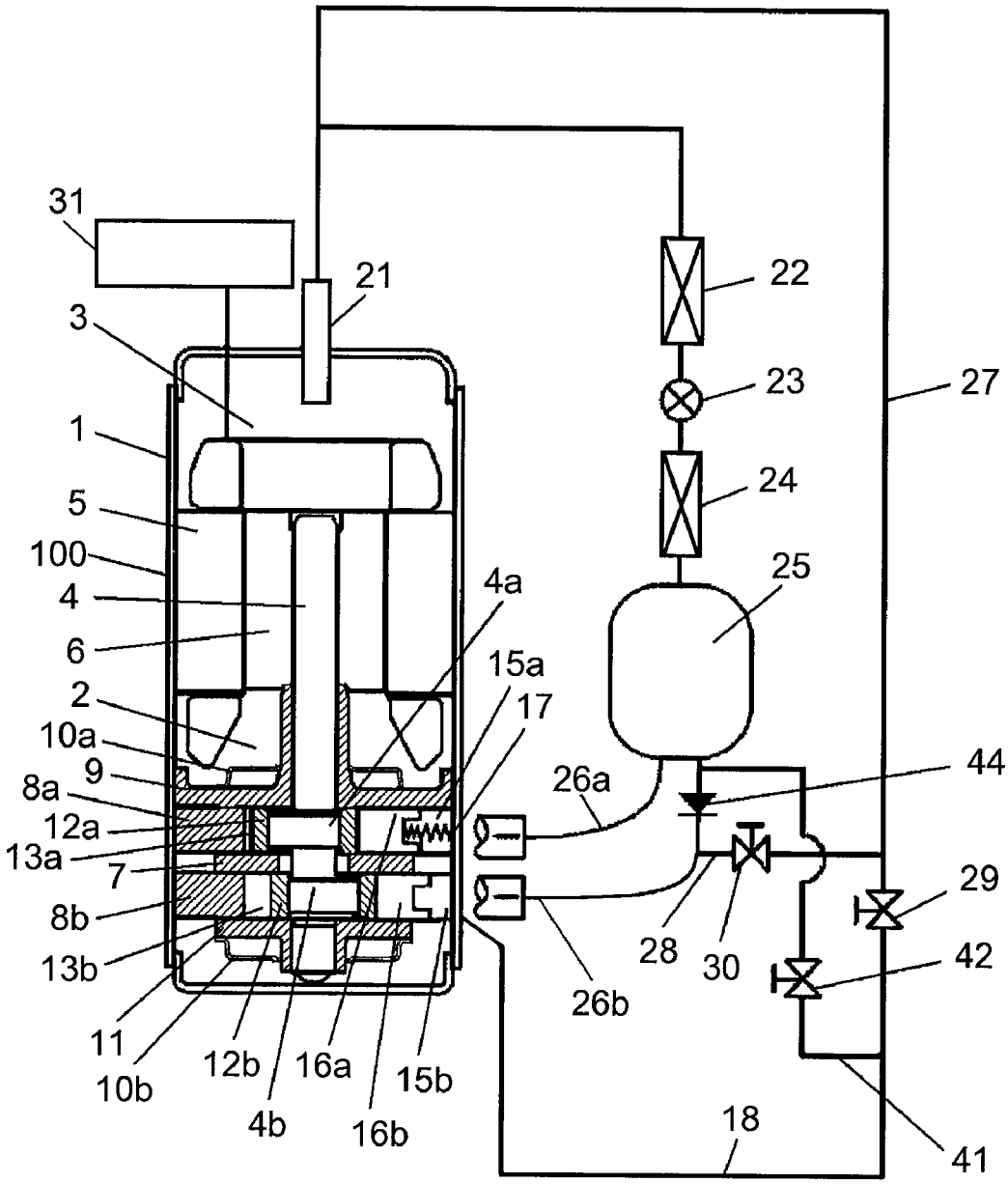
FIG. 13 shows a structure where a refrigerating cycle is formed in accordance with the ninth embodiment, and parts of the structure are changed from that shown in FIG. 12.

In this ninth embodiment, vane 16*b* is forcibly accommodated in vane room 15*b*, so that the regular operation can be positively switched to/from the special operation. Fourth on-off valve 43 can be replaced with check valve 44 as shown in FIG. 13, in this case, on-off valves 29, 30, 42 and check valve 44 form the pressure switching device.

Embodiment 10

Figure 14:
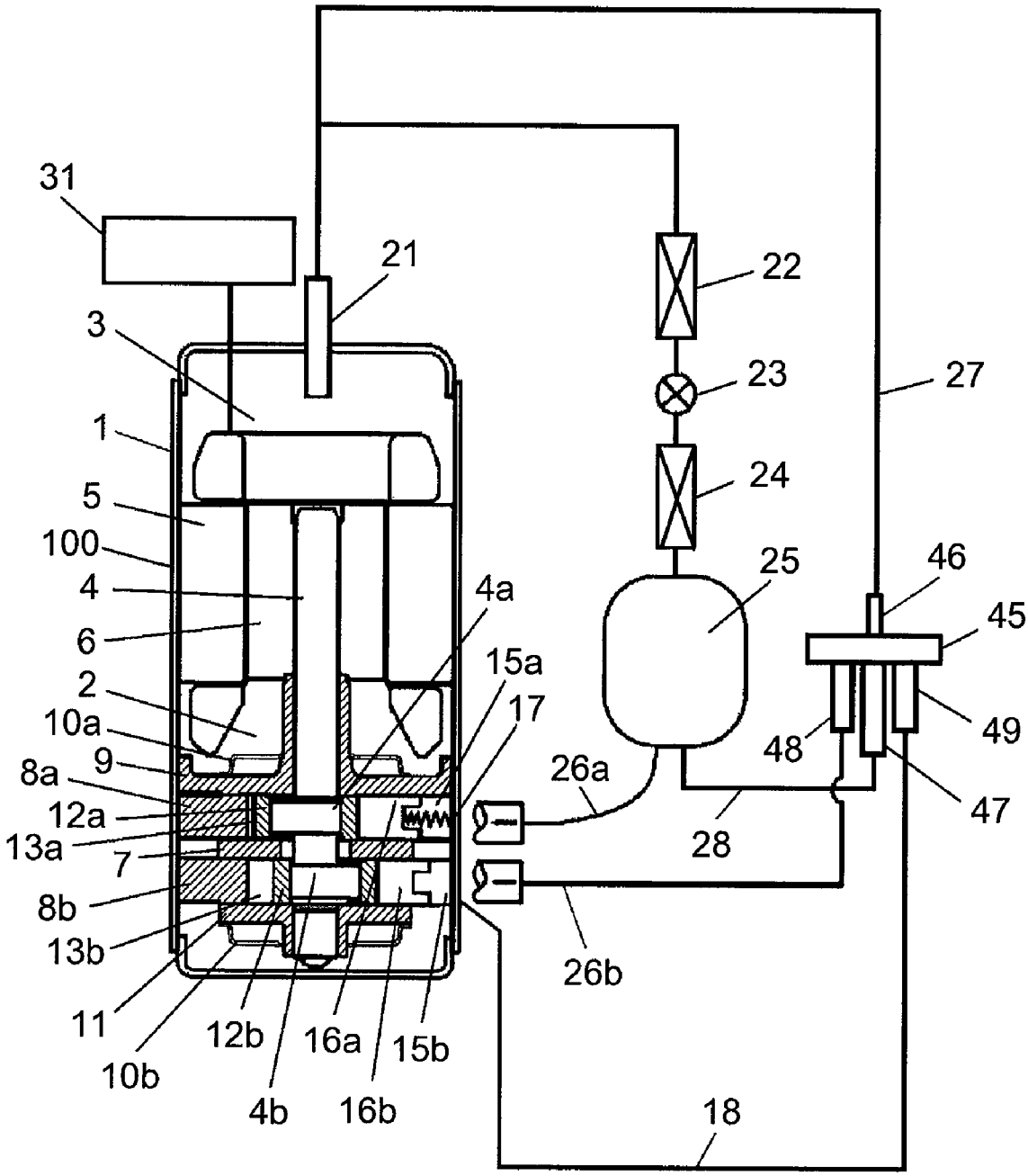
FIG. 14 shows a structure where a refrigerating cycle is formed in accordance with a tenth embodiment of the present invention.

The refrigerating cycle shown in FIG. 14 illustrates the tenth embodiment of the present invention. Four-way switching valve 45 (hereinafter referred to simply as valve 45) is coupled to high-pressure tube 46, low-pressure tube 47, first conduit 48, and second conduit 49. Valve 45 includes a coil (not shown) for valve switching, and forms a pressure switching device.

When the coil is not conducting, high-pressure tube 46 and low-pressure tube 47 are coupled to first conduit 48 and second conduit 49 respectively. When the coil is conducting, tube 46 and tube 47 are coupled to second conduit 49 and first conduit 48 respectively.

The operation of the refrigerating cycle shown in FIG. 14 is demonstrated hereinafter.

(1) Regular Operation (Full-Throttle Operation)

First cylinder 8*a* carries out the same compressing operation as it does in the first embodiment. Highly pressurized gas filled in hermetic case 1 is discharged outside hermetic case 1 via discharging tube 21.

Controller 31 makes the coil conductive. Highly pressurized refrigerant gas supplied from second conduit 49 is led to vane room 15*b* of second cylinder 8*b*. Low pressurized gas supplied from first conduit 48 is led to cylinder room 13*b*. Vane 16*b* receives a low pressure at its front end and a high pressure at its rear end, so that the front end is urged against off-center roller 12*b*, and cylinder room 13*b* carries out the compressing operation. As a result, the compressor operates on full-throttle using both of first and second cylinders 8*a* and 8*b*.

(2) Special Operation (Operation with Half-Capacity)

First cylinder 8*a* carries out the same compressing operation as it does in the first embodiment. Highly pressurized gas filled in hermetic case 1 is discharged outside hermetic case 1 via discharging tube 21.

Controller 31 shuts off the conduction of the coil. Low pressurized gas supplied from second conduit 49 is led to vane room 15*b* of second cylinder 8*b*. Highly pressurized refrigerant gas supplied from first conduit 48 is led to cylinder room 13*b*. Vane 16*b* receives a high pressure at its front end and a low pressure at its rear end, so that vane 16*b* is forcibly accommodated in vane room 15*b* and isolated from off-center roller 12*b*. Second cylinder 8*b* thus does not carries out the compressing operation. As a result, the compressor operates with a half capacity using first cylinder 8*a* only.

This tenth embodiment uses valve 45 as the pressure switching device for the switching demonstrated above, and the switching device includes the following two switching valves. A first switching valve connects the high pressure side of the refrigerating cycle to cylinder room 13*b* of second cylinder 8*b* when the coil is not conducting, and connects the high pressure side to vane room 15*b* when the coil is conducting. A second switching valve connects the low pressure side of the refrigerating cycle to vane room 15*b* when the coil is not conducting, and to cylinder room 13*b* when the coil is conducting.

Embodiment 11

Use of first cylinder 8*a* and second cylinder 8*b* having cylinder volumes different from each other allows a change in capacity to become greater between the regular operation and the special operation.

Embodiment 12

Hydro-Fluoro-Carbon (HFC) refrigerant free from chlorine has been developed in recent years in order to protect the ozone layer. The hermetic rotary compressor of the present invention can use the HFC refrigerant.

Embodiment 13

In recent years, natural refrigerants using carbon dioxide, helium, or ammonia have been developed in order to prevent the global warming. The hermetic rotary compressor of the present invention can use the natural refrigerants.

What is claimed:

1. A hermetic rotary compressor for compressing refrigerant gas, the compressor comprising:

a hermetic case;

a rotary shaft including a first and a second off-center rollers;

a first cylinder accommodating the first off-center roller;

a second cylinder accommodating the second off-center roller and including a vane, a vane groove for holding the vane in a slidable manner, and a vane room for accommodating a rear end of the vane;

a partition plate disposed between the first and the second cylinders, and air-tightly sealing a top face of the vane groove and a top face of the vane room;

a bearing frame air-tightly sealing an underside of the vane groove and an underside of the vane room; and a pressure switching device for supplying one of a high pressure and a low pressure of a refrigerating cycle into the vane room, wherein an oil-supplying groove is disposed to the vane groove for supplying lubricant to the vane, wherein the rotary shaft includes a shaft oil-passing hole of which first end opens to an underside of the rotary shaft, and of which second end opens to the partition plate between the first and the second off-center rollers, wherein the bearing frame includes a bearing frame oil-passing hole, of which first end opens to the oil-supplying groove and of which second end opens into a space in the hermetic case, and the partition plate includes a partition plate oil-passing hole, of which first end opens to the oil-supplying groove and of which second end opens to the shaft oil-passing hole.

2. The compressor of claim 1, wherein the partition plate oil-passing hole includes a through-hole drilled in a radial direction in the partition plate and having an inner end open to the rotary shaft, a vertical hole branched from the through-hole and open to the oil-supplying groove, and a packing for shutting off a periphery from a point where the vertical hole is branched from the through-hole.

* * * * *